US005584220A

United States Patent [19]

Darrah et al.

[11] Patent Number: 5,584,220

[45] Date of Patent: Dec. 17, 1996

[54] ANGLE ATTACHMENT TOOL

[76] Inventors: Scott A. Darrah, 7616 Wilderness Rd., Raleigh, N.C. 27613; Vincent Lee, No. 17, Lane 232, Section 6, Roosevelt Road, P.O. Box 29-29, Taipei, Taiwan

[21] Appl. No.: 462,041

[22] Filed: Jun. 5, 1995

Related U.S. Application Data

[63] Continuation-in-part of Ser. No. 203,646, Mar. 1, 1994, abandoned.

[51] Int. Cl.[6] ..... B25B 17/00

[52] U.S. Cl. ..... 81/57.29; 81/57.39; 81/63

[58] Field of Search ..... 81/57.29, 58–58.2, 81/57.39, 60–63.2, 177.85

[56] References Cited

U.S. PATENT DOCUMENTS

| | | | |
|---|---|---|---|
| 970,209 | 9/1910 | Fresko et al. | 81/58.1 X |
| 2,808,749 | 10/1957 | Lampke | 81/58.1 X |
| 3,972,252 | 8/1976 | Hunter | 81/57.29 |
| 4,362,072 | 12/1982 | Tillman | 81/57.29 |
| 4,372,181 | 2/1983 | Tinsley | 81/57.39 |
| 4,722,252 | 2/1988 | Fulcher et al. | 81/57.39 |
| 4,987,803 | 1/1991 | Chern | 81/57.39 |
| 5,022,289 | 6/1991 | Butzen | 81/57.39 |
| 5,365,807 | 11/1994 | Darrah et al. . | |

FOREIGN PATENT DOCUMENTS

| | | | |
|---|---|---|---|
| 601446 | 7/1925 | France | 81/57.29 |

*Primary Examiner*—James G. Smith

*Attorney, Agent, or Firm*—Flynn, Thiel, Boutell & Tanis, P.C.

[57] ABSTRACT

An attachment tool which functions as an elongate extender and has a socket driving member at one end thereof, which member has a through opening. The attachment tool is of a small dimension transverse to the elongated length thereof to facilitate its insertion into a narrow clearance space. The other end of the attachment tool has a rotatable drive element which drivingly and internally connects through a ratchet member to the socket driving member. The drive element at the remote end of the attachment tool accommodates a driving device, such as a ratchet wrench or a power tool. In a preferred embodiment, a displacement multiplier is drivingly connected to the input end of the ratchet mechanism.

13 Claims, 6 Drawing Sheets

ANGLE ATTACHMENT TOOL

CROSS REFERENCE TO RELATED APPLICATION

This is a continuation-in-part of Ser. No. 08/203,646, filed Mar. 1, 1994 now abandoned.

FIELD OF THE INVENTION

This invention relates to an improved attachment tool having a thin elongate profile for accommodating a socket element at one end for providing access to a nut or bolt head in a remote or difficult-to-access location, and particularly to an improved attachment tool which at one end has a through hole to accept a through-hole socket element and which at the other end is capable of receiving a rotary drive stud such as associated with a conventional ratchet wrench or power driver.

BACKGROUND OF THE INVENTION

The tightening or loosening of threaded fasteners such as nuts and bolts is often accomplished by use of a selected socket element which accommodates the size of the particular bolt or nut, with the socket element in turn being releasably attached to a manual or power-driven socket wrench. Such arrangements are well known, and commonly utilized for all types of mechanical devices and structures.

In many instances, however, access to the fastener is complicated by either the remote location of the fastener, or the lack of convenient access due to location of the fastener in a crowded environment. Various extension devices and the like have been developed for use in some of these situations, although accessing a threaded fastener with a conventional socket element and wrench is in many situations extremely difficult and often times impossible to achieve. In particular, in situations where the fastener is disposed in close proximity to some other rigid wall or structure which is disposed closely adjacent and spaced only a small distance from the end of the fastener, accessing the fastener with a socket element is difficult, particularly in those situations wherein the socket element is mounted on and projects sidewardly from a conventional socket wrench, since this overall combination requires significant clearance, and such clearance is often times not available. This becomes particularly difficult in situations where the fastener is positioned not only in a limited clearance environment, but is also remotely located relative to the point of access such that a conventional socket wrench, or the use of conventional extenders, is not possible.

Further, in these situations the very limited access often makes if difficult to apply sufficient torque to facilitate either loosening or tightening of the fastener, and hence this further increases the difficulty of positioning fasteners in such locations.

Accordingly, it is an object of this invention to provide an improved extender-type attachment tool particularly suitable for use with a socket element, which attachment tool facilitates access to a threaded fastener in a situation where the fastener is remotely located and is difficult to access, and which overcomes many of the disadvantages associated with prior structures which have been attempted to be used in such situations.

More specifically, the improved attachment tool functions as an elongate extender and has a socket-receiving opening at one end thereof as defined within a socket driving element, which opening is a through opening to facilitate receiving a socket or like element from either side thereof, the socket element itself preferably having a through opening. The attachment tool is of a narrow or thin dimension transverse to the elongated length thereof to facilitate its insertion into a narrow clearance space, with the drive hub of the removable socket element being accommodated substantially within the thickness of the attachment tool. The other or remote end of the attachment tool has a rotatable drive part which drivingly and internally connects to a socket driving element. The drive part at the remote end of the attachment tool accommodates the drive stud of a driving wrench, such as a conventional manually-activated ratchet wrench or power tool, which wrench or power tool can extend at an angle to the tool to facilitate activation of the driving element.

In a manually-activated embodiment of the attachment tool, the internal drive arrangement provides a torque step up between the drive part and the socket driving element to provide increased torque to facilitate tightening or loosening of a threaded fastener.

A further object of the invention is to provide an improved attachment tool which, in addition to possessing structural and functional advantages as summarized above, in addition incorporates a speed increase mechanism coupled between the drive shaft and the driving ratchet mechanism for increasing the stroke or angle of oscillation of the ratchet mechanism to in turn cause an increase in the angular displacement of the output gear for each revolution of the drive shaft, thereby increasing the output and more specifically the speed or number of revolutions of the output in proportion to the rotational input speed. This thus increases the speed and efficiency of use of the attachment tool.

In the attachment tool of this invention, as aforesaid, the speed increasing mechanism includes an intermediate yoke which is pivotally interconnected between the drive shaft and the oscillating ratchet mechanism, which yoke has an intermediate pivot disposed so as to provide output and input lever arms which define a stroke or displacement increase between the input and output ends thereof, which stroke increase is then applied to the ratchet mechanism and ultimately to the output gear to increase the effective output speed thereof.

Other objects and purposes of the invention will be apparent to persons familiar with structures of this general type upon reading the following specification and inspecting the accompanying drawings.

Figure 1:
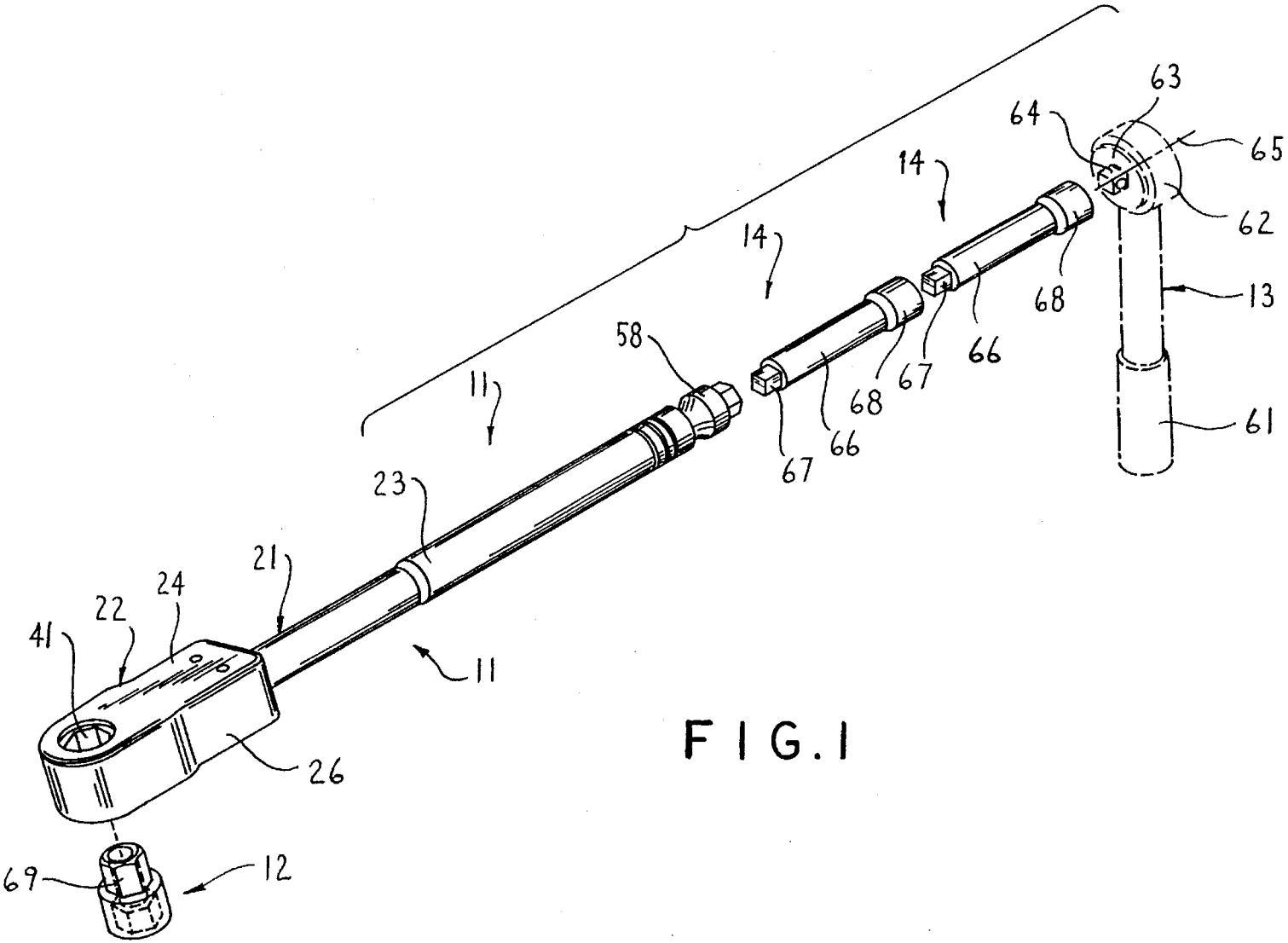
FIG. 1 is a perspective view which illustrates one embodiment of the improved attachment tool of the present invention, and its cooperation between a socket element and a conventional ratchet wrench.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the attachment tool and designated parts thereof. Said terminology will include the words specifically mentioned, derivatives thereof, and words of similar import.

DETAILED DESCRIPTION

FIG. 1 illustrates therein an attachment tool 11 according to the present invention. This tool 11 is adapted to mount a socket element 12 on one end thereof, which socket element 12 is adapted for cooperation in a conventional manner with a threaded fastener such as a nut or bolt head. The other end of the attachment tool 11 is adapted to be driven by a conventional ratchet wrench 13. If desired, and as illustrated by FIG. 1, one or more conventional extenders 14 may be drivingly coupled between the attachment tool 11 and the wrench 13.

Figure 2:
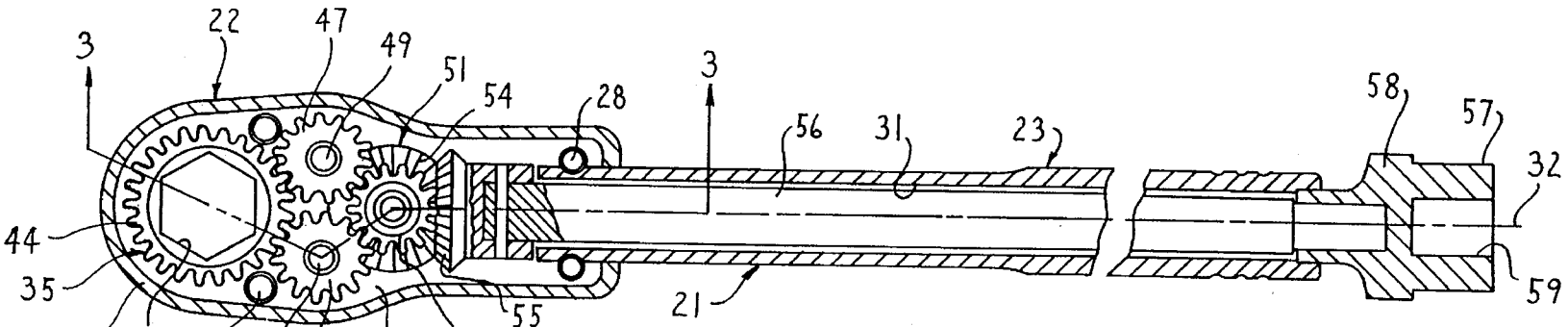
FIG. 2 is a plan view of the attachment tool of FIG. 1 with the upper portion of the housing removed so as to illustrate the interior structure.
Figure 4:
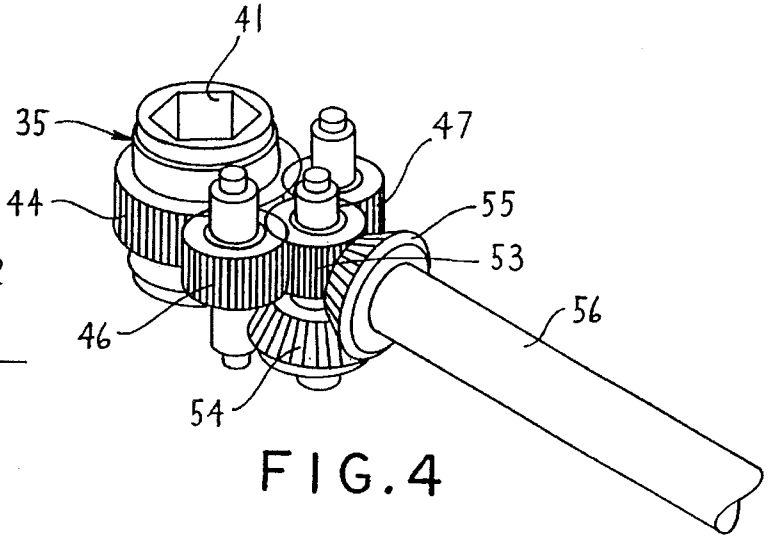
FIG. 4 is a fragmentary perspective view which illustrates the cooperation between the gears associated with the embodiment of FIGS. 1–3.
Figure 3:
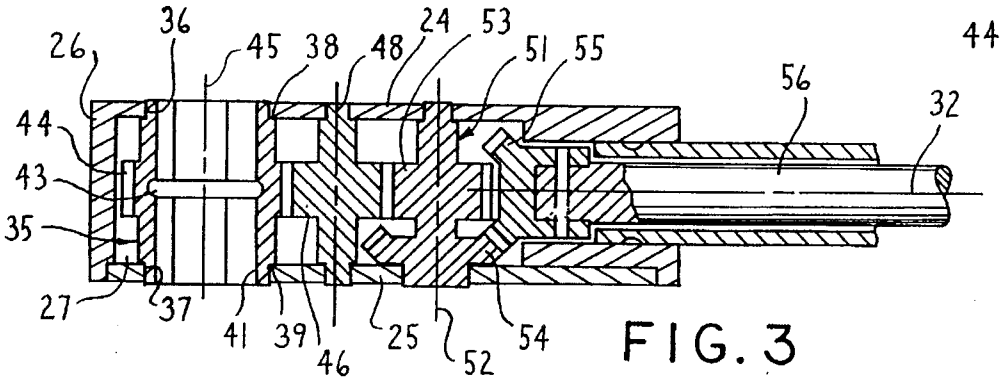
FIG. 3 is a fragmentary sectional view taken substantially along line 3—3 in FIG. 2.

The attachment tool 11, as illustrated by FIGS. 2 and 3, includes an elongate hollow housing 21 constructed of a rigid material, normally metal. This housing 21 includes a hollow boxlike portion 22 adjacent one end thereof, and also includes an elongate tubular portion 23 which projects outwardly from the boxlike portion 22 and defines the other end of the housing.

The boxlike portion 22 is defined by generally spaced and substantially parallel end walls 24 and 25, these walls being respectively top and bottom walls in the illustrated embodiment. The end walls 24 and 25 are joined together by a peripheral side wall 26 whereby the boxlike housing portion 22 defines an interior chamber 27. The bottom wall 25 is, in the illustrated embodiment, removably attached to the housing by screws 28.

The elongate tubular housing portion 23 has an elongate interior cylindrical wall 31 concentric with an axis 32 which extends longitudinally of the tubular housing portion 23 in intersecting relationship with the interior chamber 27. The inner end of the tubular portion 23 projects through the peripheral side wall 26 for providing open communication between the housing portions 22 and 23, with tubular portion 23 being suitably fixed to the housing portion 22, such as by the rear screws 28 which engage an exterior groove formed around the tubular portion.

The boxlike housing portion 22 mounts a socket or tool-driving member 35 within the interior thereof. This driving member 35 is constructed as an elongate sleeve which extends generally perpendicularly between the end walls 24 and 25, the latter having coaxially aligned circular openings 36 and 37 respectively formed therein for rotatably supporting the opposite axial ends of the drive member 35. Suitable shoulders 38 and 39 are defined by the drive member and are positioned adjacent the respective end walls 24 and 25 to maintain proper rotatable support and position of the drive member 35 within the boxlike housing portion.

The tool-driving member 35 has a tool-receiving opening 41 extending coaxially therethrough. This latter opening 41 is defined by a toothed or polygonal annular surface so as to permit driving engagement with a hub part of a socket element, as explained below. The surface 41 may also have an annular groove or recess 43 formed therearound for accommodating a detent on the hub part of the socket element.

The tool-driving member 35 also fixedly mounts thereon an annular gear member 44 which defines external gear teeth, with this sleeve gear member 44 being concentric with the longitudinal axis 45 of the member 35. The annular driving surface 41 is also concentric about this axis 45. The axis 45 extends generally perpendicularly between the end walls 24 and 25, and also substantially perpendicularly intersects an extension of the axis 32.

The gear member 44 is maintained in continuous meshing engagement with a pair of intermediate gears 46 and 47, the latter being positioned within the chamber 27 and disposed for rotation about substantially parallel axes 48 and 49. The axes 48 and 49 extend generally parallel with the axis 45, and are positioned substantially equally spaced on opposite sides of the axis 32. The intermediate gears 46 and 47 have hub portions at opposite ends thereof which are suitably rotatably supported on the housing end walls 24 and 25.

Both intermediate gears 46 and 47 are also maintained in continuous meshing engagement with a compound gear member 51 which is also positioned within the chamber 27 and is rotatable about an axis 52 which extends parallel to the axis 45 and substantially perpendicularly intersects the axis 32. The compound gear 51 includes an output gear 53 which externally surrounds and projects radially outwardly of the compound gear member 51 in concentric relationship to the axis 52 for engagement with the gears 46–47.

Compound gear member 51 also includes an input gear portion defined by a bevel gear 54 which is defined on one end of the member 51 in surrounding relationship to the axis 52. The bevel gear 54 is maintained in continuous meshing engagement with a driving bevel gear 55 which is coaxially fixed to the inner end of an elongate drive shaft 56, the latter extending coaxially of the tubular housing portion 23 and being suitably rotatably supported therein by any conventional means, such as sleeve bushings (not shown).

The other or outer end of drive shaft 56 projects outwardly beyond the remote end of the tubular housing portion 23 and has an enlarged drive part 58 coaxially fixed thereto. The drive part 58 defines therein a suitable socket or opening 59 which opens coaxially of the drive shaft for accommodating a drive hub, as explained below, the socket or opening 59 being of a noncircular configuration, and typically of a square cross section. This drive part 58 at the free end thereof also preferably has an exterior noncircular surface profile 57, namely a flat side profile so as to also permit exterior engagement with a driving tool.

Referencing FIG. 1, there is illustrated a conventional ratchet wrench 13 which can be utilized for effecting rotatable driving of the drive shaft 56. The ratchet wrench 13 includes an elongate handle 61 having a head 62 at one end thereof, which head 62 mounts therein a conventional reversible one-way ratchet mechanism 63 to which is secured a drive stud 64, conventionally of square cross section. The drive stud 64 can be rotatably driven about the axis 65 in a conventional manner. The drive stud 64 is adapted for insertion into the opening 59 provided at the outer end of the drive shaft 56 to permit rotatable driving of the drive shaft 56.

Alternatively, if greater distance or separation between the fastener and ratchet wrench is required, then one or more extenders 14 can be coupled between the ratchet wrench 13 and the attachment tool 11. As illustrated by FIG. 1, the conventional extender 14 includes an elongate rod or body 66 having a drive stud 67 coaxially projecting from one end thereof, which drive stud 67 is sized the same as the drive stud 64 and can be slidably inserted into the opening 59 associated with the free end of the drive shaft 56. The other end of the extender 14 has a socket part 68 defining therein a drive opening which can accommodate either the drive stud 67 of a further extender, or the drive stud 64 of the ratchet wrench. The use of such extenders for coupling to a ratchet wrench is conventional.

In use of the attachment tool 11, a socket element 12 of selected size is nonrotatably drivingly engaged with the drive member 35 by axially slidably inserting the drive hub 69 of the socket element 12 into the drive opening 41, which insertion can occur from either side of the boxlike housing portion 22 due to the through drive opening 41. The socket element 12 is preferably of the type having a through opening 71 so as to permit an elongate threaded rod to project therethrough if necessary. A preferred form of such socket element 12 is disclosed in our copending U.S. application Ser. No. 08/081 809, now U.S. Pat. No. 5,365,807. The attachment tool 11, mounting thereon the proper socket element 12, can then be moved transversely into a small clearance space which exists adjacent one end of a fastener, such as a small clearance space between the fastener and an adjacent wall or housing. By moving the socket-bearing end of the attachment tool transversely into the small clearance space, this enables the socket 10 element 12 to be aligned with the fastener, and then moved axially into engagement with the fastener. Thereafter the ratchet wrench 13 can be utilized to effect rotatable driving of the shaft 56, either directly or through one or more extenders 14. The rotatable driving of the shaft 56 effects rotation of the compound gear 51, and it in turns drives the two intermediate gears 46 and 47 which then rotatably drive the gear member 44 to cause corresponding rotation of the socket element 12.

The intermediate gears 46 and 47 in the illustrated embodiment have a diameter which is about one-half the diameter of the gear 44 so that the gear 44 is rotatably driven at about one-half the speed as the driving gear 55, although the ratios between the various gears can obviously be varied as desired. The presence of two intermediate gears 46,47 connected between the gear 53 and the output gear 44 is desirable since these two gears 46,47 and the symmetrical positioning thereof on opposite sides of the plane defined by the axes 45 and 52 provides for more uniform application and transfer of force relative to the gears 51 and 44.

In addition, the significant speed reduction due to gear 44 having a diameter substantially greater than the diameters of gears 46,47, this diameter ratio and the corresponding speed reduction preferably being about two to one, in turn causes about a two-to-one torque increase (i.e. mechanical advantage) from the drive shaft 56 to the output gear 44. This assists and in fact significantly improves the capability of the attachment tool with respect to loosening or tightening threaded fasteners.

With the improved attachment tool 11 of this invention, the overall height of the assembled tool 11 and socket element 12 as measured along the axis 45 substantially corresponds to the overall height of the socket element 12 when considered by itself. In contrast, the overall height of the socket element 12 when mounted directly on the drive stud 64 of a conventional ratchet wrench 13 is significantly greater due to the additional thickness of the head 62. The attachment tool 11 of this invention thus provides access to significantly smaller clearance spaces, and in particular provides access into spaces which would not be possible when using a conventional ratchet wrench.

Also, when using this tool 11, the drive axis 65 of the wrench 13 extends at an angle, substantially a perpendicular angle to the axis 45 of the socket element, rather than being aligned therewith such as when the socket element mounts directly on the ratchet wrench. This can greatly increase accessibility as well as the convenience of gripping and rotating the wrench.

The attachment tool 11 in a preferred embodiment has an overall height as measured between the end walls 24 and 25 which is less than one-sixth of the overall longitudinal length of the housing, with this height preferably being about one inch, and the housing preferably having an overall longitudinal length of no less than about six inches, with the overall length preferably being about 10 to 12 inches. The boxlike housing portion 22 has a width as measured transversely thereacross of no more than about three inches. In addition, the longitudinal length of the boxlike housing portion 22 is preferably less than one-half of the overall longitudinal length of the attachment tool.

Referencing now FIGS. 5–8, there is illustrated a second embodiment of an attachment tool according to the present invention, which embodiment is designed specifically for driving cooperation with a power driver having a rotary drive member, such as a portable electric drill. In this embodiment, many parts thereof structurally and functionally correspond to parts of the embodiment of FIGS. 1–4 as described above.

As shown by FIGS. 5–8, the attachment tool 111 according to this second embodiment is again of a generally thin but elongate construction and includes an elongate housing defined generally by substantially thin parallel top and bottom housing plates or walls 113 and 114, respectively. These plates are fixedly secured by a plurality of fasteners 115 threadedly connected therebetween. A pair of support blocks 116,117 are also fixedly positioned transversely between the plates 113,114 generally adjacent opposite ends of the tool, with these support blocks defining coaxially aligned openings 120 therethrough so as to function as support bearings for an elongate drive shaft 118. This shaft 118 extends longitudinally of the attachment tool and is rotatable about its axis 119.

One end of the drive shaft 118 projects outwardly beyond the rear bearing block 116 and has a drive part 121 coaxially fixed thereto. This drive part 121 substantially corresponds to the drive part 58 of FIG. 1 in that it includes interior and exterior noncircular surfaces which are adapted to be engaged with a suitable power-driven tool. For example, a rotatable power-driven stud, such as associated with a portable electric drill, can be inserted into the interior socket of the drive part 121 to effect unidirectional rotation of the drive shaft 118.

The other end of the drive shaft 118 projects outwardly beyond the front bearing block 117 and is drivingly engaged with a ratchet mechanism 122 which is sandwiched between the housing plates 113 and 114, which ratchet mechanism 122 in turn effects a unidirectional steplike rotational driving movement of a tool-driving member 123 in either selected rotational direction.

The tool-driving member 123 is generally similar to the member 35 described above relative to FIGS. 1–4. That is, the tool-driving member 123 is constructed as an elongate sleeve which extends generally perpendicularly between the housing plates 113 and 114, the latter having coaxially aligned circular openings 124 formed therein for rotatably supporting the opposite axial ends of the driving member 123. The tool-driving member has a tool-receiving opening 125 extending coaxially therethrough, this being defined by a toothed or polygonal annular surface to permit driving engagement with a hub part of a socket element, such as the socket element 12 of FIG. 1 as described above.

Tool-driving member 123 also fixedly mounts thereon an annular gear or ratchet member 126 which externally surrounds the drive member, with this gear or ratchet member being concentric about the axis 127 of the drive member 123. This axis 127 extends generally perpendicularly between the housing plates 113–114, and also substantially perpendicularly intersects an extension of the shaft axis 119.

Considering now the ratchet mechanism 122, it includes a ratchet housing 131 having a pair of generally parallel housing plates or walls 132, the latter being respectively positioned directly adjacent the inner surfaces of the housing plates or walls 113–114 so that the ratchet housing 131 is closely confined within and between the plates 113–114 but is swingably movable relative thereto about the axis 127. For this purpose, the housing plates 132 have aligned openings 133 therethrough which rotatably support hub portions defined on opposite ends of the tool-driving member 123 so that the ratchet housing 131 is supported between the plates 113–114 but is angularly swingable relative to the housing about the axis 127.

The ratchet housing 131 also includes therein an open region or recess 134 which is defined closely adjacent one side of the annular ratchet 126. This recess 134 accommodates therein a ratchet element 135 and a switching element 136.

The ratchet element 135 is mounted on a shaft 137 which projects generally perpendicularly between the housing plates 113–114 and is rotatably supported by the housing plates 132. The upper end of shaft 137 projects upwardly through a sidewardly-elongated slot 145 as formed through the top plate 113. The ratchet element 135 includes armlike ratchet portions which project from opposite sides of this latter shaft, with one ratchet arm having ratchet teeth 138 thereon adapted for engagement with the driven ratchet 126, and the other ratchet arm having ratchet teeth 139 thereon adapted for engagement with the driven ratchet 126. However, the overall positional relationship of the ratchet element is such that only one of the teeth 138 or 139 can be engaged with the driven ratchet 126 at one time.

The ratchet element 135 has a cam surface 141 on the rearward side thereof which is engaged with a nose element 142 provided on the switching element 136, which nose element conventionally comprises a spring-urged ball or pin. This switching element 136 is secured to a further shaft 143 which is spaced rearwardly of but extends generally parallel with the shaft 137, and is also rotatably supported on housing plates 132. Shaft 143 projects upwardly through a sidewardly elongated slot 147 in the top plate 113 and has a leverlike activating element 144 secured thereto. This latter element 144 is a thin platelike lever which is positioned so as to closely overlie the exterior surface of the top plate 113, but is movable relative thereto. The activating element 144 has an arcuate slot formed in the edge portion at one end thereof for cooperation with the upper projecting end of the shaft 137 so that the activating element 144 can be manually angularly displaced between first and second positions which respectively result in the ratchet teeth 138 and 139 being engaged with the driven ratchet 126. The other end 146 of the activating element is defined generally as an elongate lever so as to permit manual engagement with the element 144 to permit switching thereof between the aforesaid two positions.

The end of the ratchet housing 131 remote form the tool-driving member 123 is disposed closely adjacent the inner end of the drive shaft 118, and is provided with a slot 151 extending transversely thereof. A drive pin 152 is fixed to and projects axially forwardly of the drive shaft 118 and projects into the slot 151. The drive pin 152 is eccentrically (i.e., radially) displaced relative to the shaft axis 119. During rotation of the shaft 118, the pin 152 and its engagement within the slot 151 causes the ratchet housing 131 to angularly oscillate back and forth through a limited angular extent about the axis 127, accompanied by reciprocal (i.e., up and down) displacement of the pin 152 longitudinally along the slot 151.

In use of the attachment tool 111 of FIGS. 5–8, the drive hub of the socket 12 (FIG. 1) is inserted into the opening 125 of the tool-driving member 123. In addition, the activating lever 144 is manually moved into the position representing the desired direction of rotation, either clockwise or counterclockwise. The attachment tool 111 bearing the socket element thereon is then engaged with a threaded fastener, and a suitable power drive such as a rotatable drive stud associated with a rotary drill or similar power tool is engaged with the drive part 121 so as to effect rotation of the shaft 118.

Figure 5:
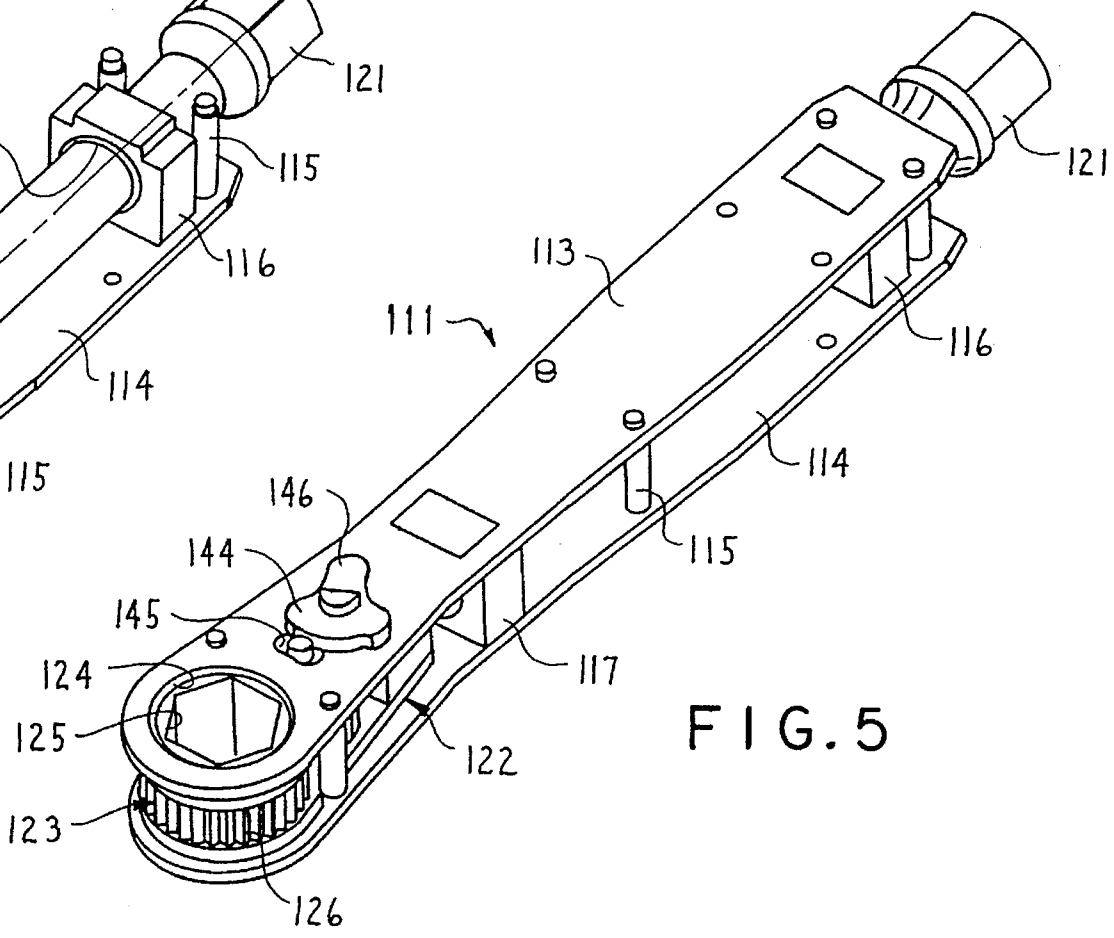
FIG. 5 is a perspective view which illustrates a second embodiment of the improved attachment tool of the present invention, which embodiment includes a ratchet mechanism and is adapted to be power-driven.
Figure 6:
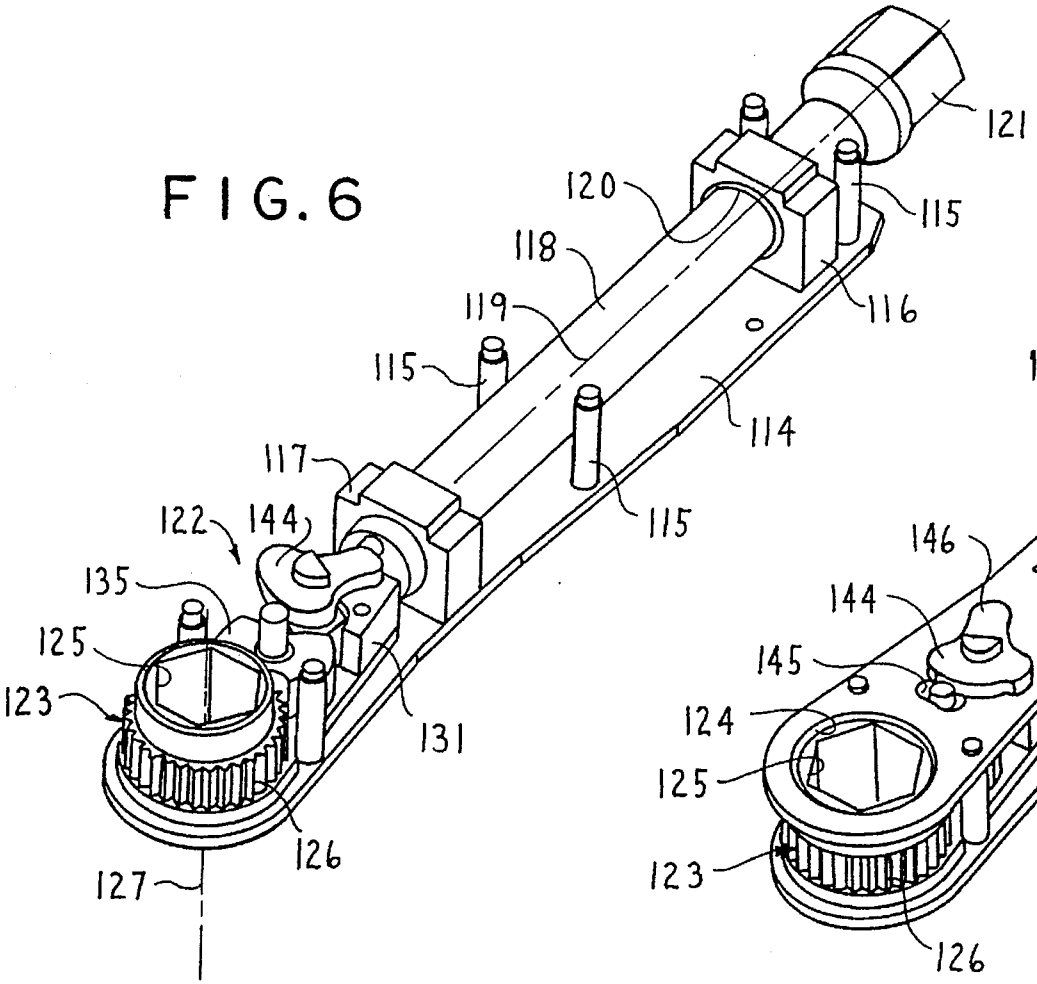
FIG. 6 is a perspective view similar to FIG. 5 but showing the top plate of the housing removed.
Figure 8:
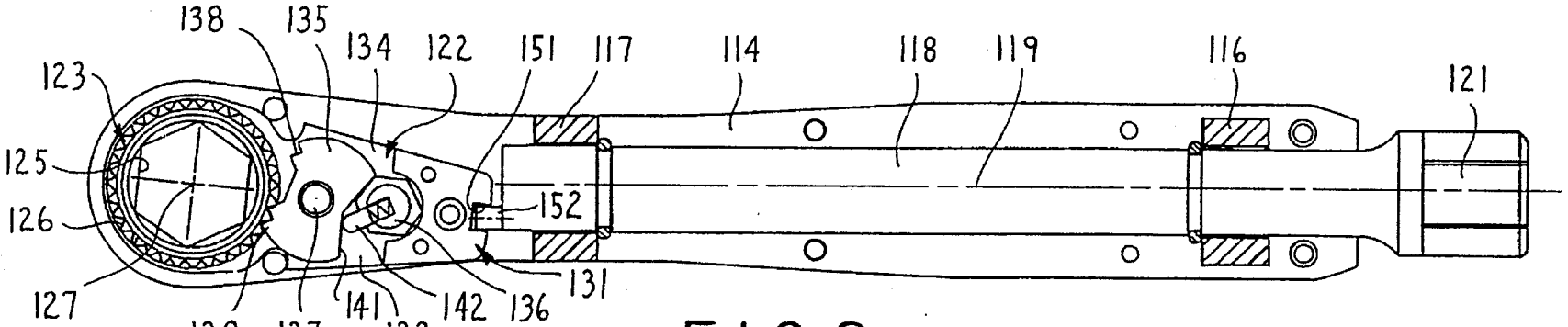
FIG. 8 is atop view with the top housing plate removed and showing the ratchet drive arrangement.

If the activating lever 144 is in the position illustrated by FIGS. 5 and 8, then the ratchet teeth 139 are engaged with the driven ratchet 126 whereby the tool-driving member 123 will be unidirectionally rotatably driven in a steplike manner in a clockwise direction in response to angular back-and-forth oscillation of the ratchet housing 131 caused by rotation of the drive shaft 118.

Conversely, if the activating element 144 is in the reverse position as illustrated by FIG. 2, then the other ratchet teeth 138 are engaged with the driven ratchet 126 so that the tool-driving member 123 will be unidirectionally rotatably stepped in a counterclockwise direction in response to the angular oscillation of the ratchet mechanism 122.

In the embodiment of FIGS. 5–8, the attachment tool again has an overall height of about one inch, and an overall length of about eight to ten inches.

Each of the tools 11 and 111 are also suitable for driving elements other than sockets. For example, an interchangeable head can be mounted within the opening 41 or 125 for nut or screw driving, or a low speed drill head can be mounted in the opening 125.

Figures 9, 12:
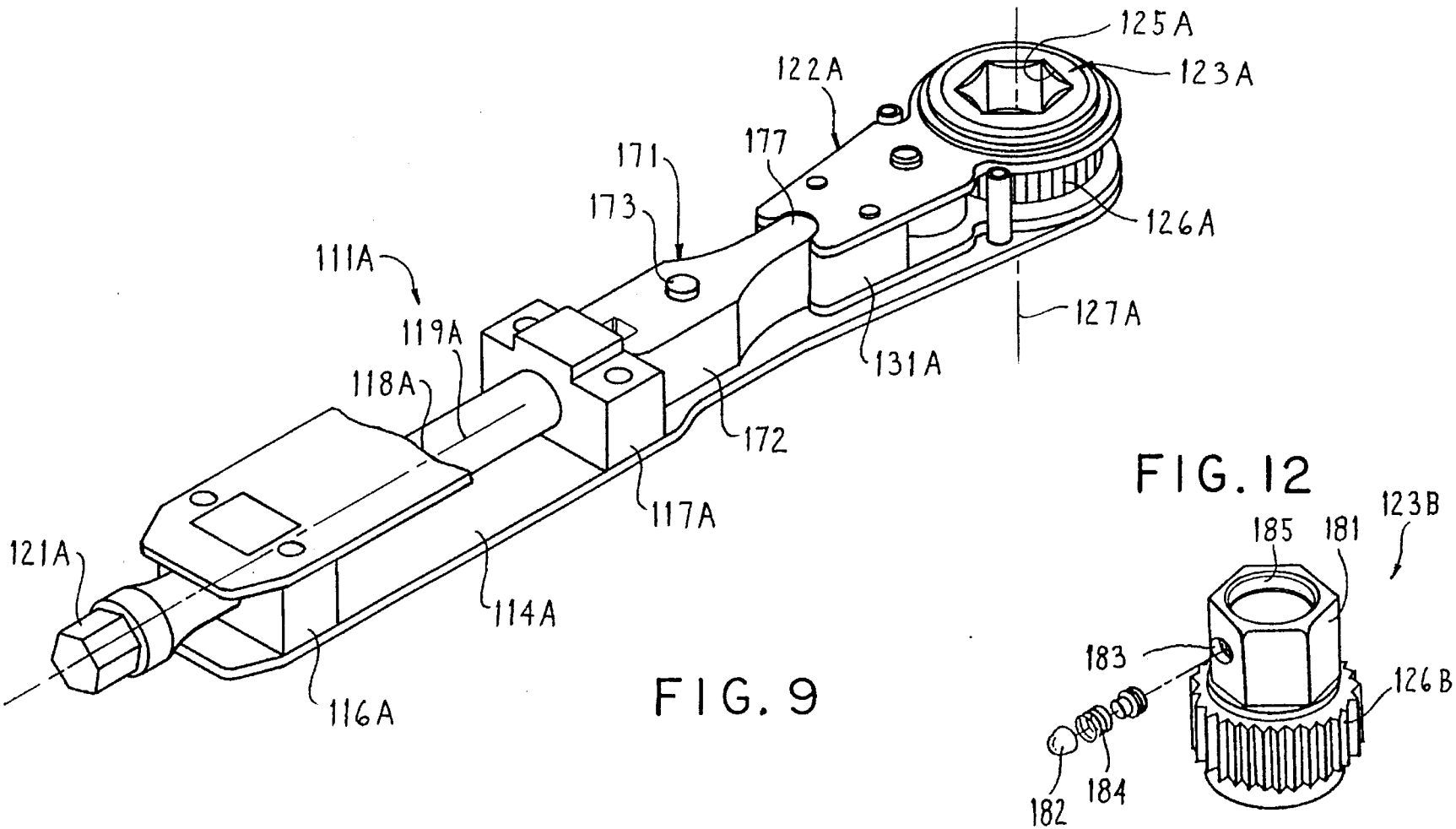
FIG. 9 is a perspective view of a third and preferred embodiment of an attachment tool according to the present invention, a part of the top housing plate being broken away for clarity of illustration.
FIG. 12 is a perspective view, partially exploded, showing an alternate tool driving member.
Figure 10:
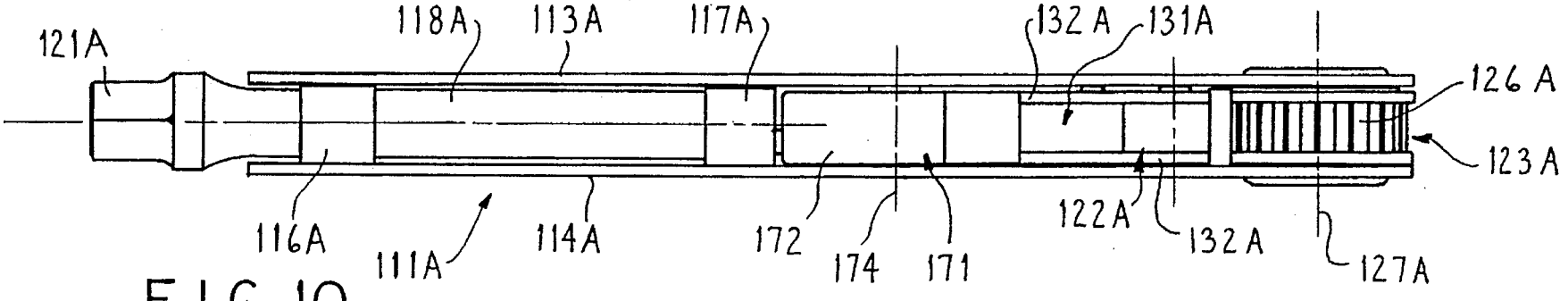
FIG. 10 is side elevational view of the attachment tool of FIG. 9.
Figure 11:
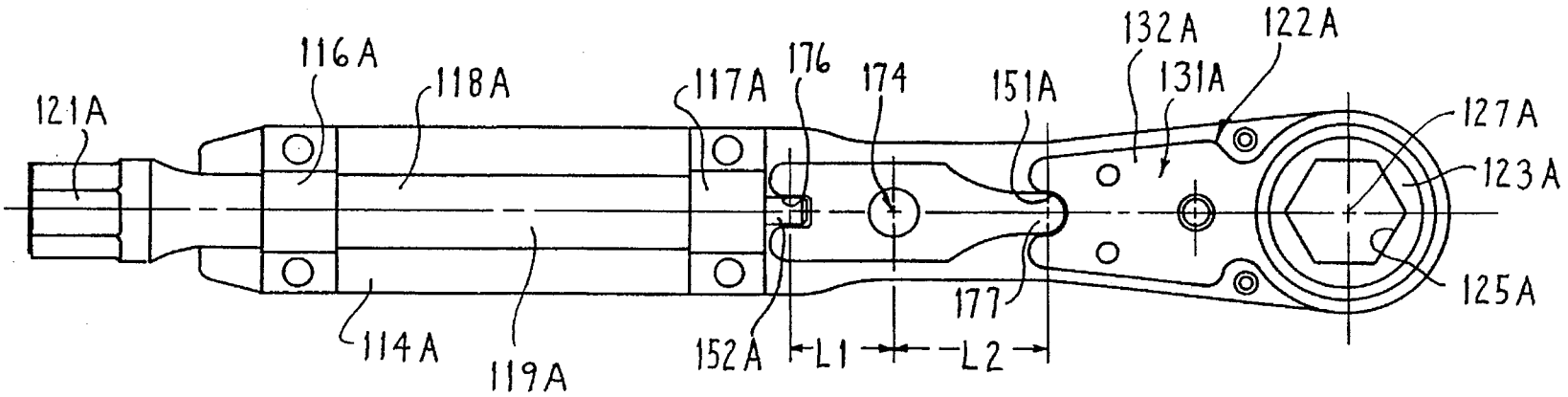
FIG. 11 is a top view of the tool shown in FIG. 9, the top plate being removed for clarity of illustration.

Referencing now FIGS. 9–11, there is illustrated a third and preferred embodiment of an attachment tool 111A according to the present invention. The tool 111A of FIGS. 9–11 structurally and functionally corresponds in many respects to the tool 111 of FIGS. 5–8. Accordingly, corresponding parts of the tool 111A (FIGS. 9–11) are designated by the same reference numerals utilized to designate corresponding parts of the tool 111 (FIGS. 5–8), except for the addition of an "A" thereto, whereby further detailed description of these corresponding parts is believed unnecessary.

In the tool 111A, there is provided a stroke or displacement multiplier 171 drivingly interconnected between the drive shaft 118A and the ratchet mechanism 122A so as to increase the stroke or displacement of the tool-driving member 123A per rotation of the drive shaft 118A, and thus effectively increase the number of rotations of the tool-driving member 123A per unit of time. This stroke multiplier 171 comprises a lever-like member 172 which is elongated longitudinally of the tool and is interposed longitudinally between the drive shaft 118A and the ratchet mechanism 122A. The lever member 172 is disposed between the opposed and generally parallel housing walls or plates 113A and 114A, and is pivotally supported by a pivot pin 173 which extends through the lever member and has opposite ends thereof appropriately supported on the parallel housing plates 113A and 114A. This pivot pin 173 defines a pivot axis 174 which extends generally parallel with the rotational axis 127A of the tool-driving member 123A.

Figure 7:
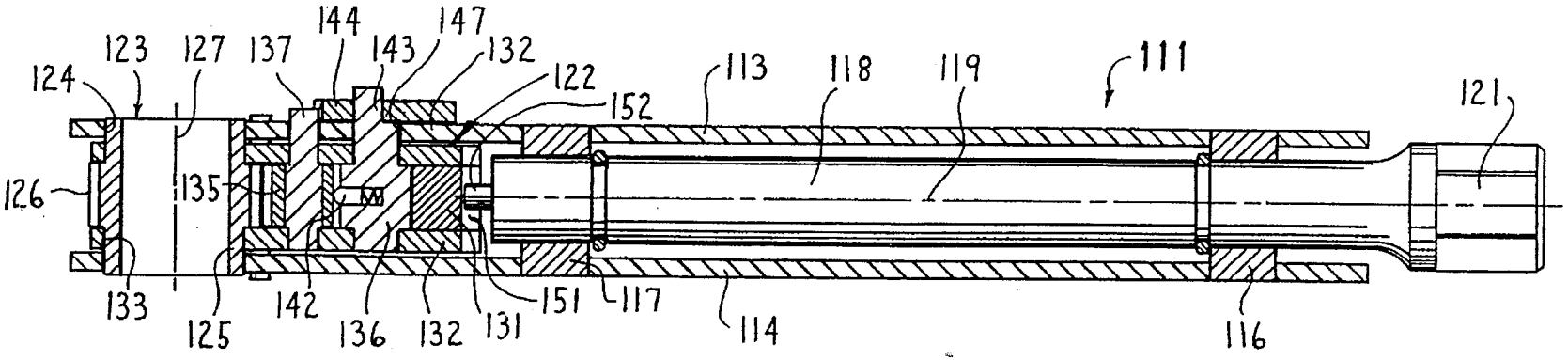
FIG. 7 is a side elevational view, partially in cross section, of the embodiment of FIG. 5.

The lever member 172 at the rearward or input end thereof is provided with a slot 176 extending transversely therethrough generally between the top and bottom housing plates, and the eccentric drive pin 152A on drive shaft 118A projects into the slot 176 (in a manner similar to the engagement of the pin 152 within the slot 151 in FIGS. 7 and 8) to effect angular oscillation of lever member 172 about pivot axis 174 in response to rotation of drive draft 118A.

The forward or output end of lever 172 has a nose or end part 177 which projects radially outwardly from the axis 174 and is appropriately rounded at the free end thereof, such as having a substantially semi-cylindrical exterior end surface, and this nose part 177 in turn projects into a slot 151A formed at the rearward end of the ratchet housing 131A. The slot 151A is suitably configured so as to closely and movably accommodate the nose part 177 therein so that angular oscillation of lever member 172 in turn causes a driving angular oscillation of the ratchet housing 131A.

The pivot axis 174 is preferably positioned lengthwise between the slot 176 and the nose part 177 so as to effect a stroke or displacement increase between the input and output ends of the lever member 172. For this purpose, the axis 174 of pivot pin 173 is preferably disposed longitudinally rearwardly of the lever member 172 so as to be closer to the slot 176 then to the nose part 177. For example, as diagrammatically illustrated in FIG. 11, the length between the pivot axis 174 and the normal contact point between the drive pin 152 and the slot 176 is designated L1, and in a similar fashion the distance or lever arm between the axis 174 and the normal contact point between the nose part 177 and the slot 151A is designated L2. The arm L1 is the input arm since it is driven directly from the shaft 118A, and the arm L2 is the output arm since it effects direct driving or oscillating of the ratchet mechanism 122A. The arm L2 is preferably significantly greater in length than the arm L1, with the length of the output arm L2 preferably being at least about 1.5 times the length of the input arm L1.

With the attachment tool 111A as described above, rotation of the drive shaft 118A by a suitable driving tool, such as an air tool, causes the intermediate displacement multiplying lever 172 to be angularly oscillated at a high rate of speed about the axis 174. While the input and output ends of the lever 172 both move through the same angular displacement, nevertheless the actual transverse distance travelled by the nose part 177 is significantly greater than the transverse distance travelled by the input slot end of the lever 172 due to the L2/L1 ratio being greater than 1.0. The greater transverse displacement of the nose part 177 is transmitted directly to the input or slotted end of the ratchet housing 131A, whereupon this ratchet mechanism 122A continues to oscillate at the same rate, but both the angular extent and the transverse displacement of each oscillation has been increased, such being permitted inasmuch as the tool housing has open sides which do not restrict or conflict with the desired angular oscillation. This increased angular displacement of the ratchet mechanism 122A causes the driving pawl (such as the pawl 135 in FIG. 8) to also be angularly displaced through a greater stroke about the axis 127A, which stroke is sufficient as to allow the pawl to travel over two adjacent teeth of the gear wheel 126A during the return stroke, and thus in turn cause the gear wheel 126A to be rotated through an angular extent equal to two teeth during the driving stroke. This is in contrast to conventional ratchet mechanisms which normally engage and drive the gear wheel through an amount equal to only a single tooth during each cycle of oscillation. The net result is that the output speed of the tool-driving member 123A is significantly increased.

Referring now to FIG. 12, there is illustrated a variation of a tool-driving member 123B which can be substituted for the tool-driving member 123A if desired. This variation of the tool-driving member 123B is substantially identical to the member 123A in terms of the gear 126B and the manner in which it is rotatably supported on the housing and driven by the ratchet mechanism. This member 123B, however, has a drive hub 181 projecting axially outwardly from one end thereof so as to project outwardly beyond one of the housing walls or plates 113A or 114A. This hub 181 is provided with a conventional flat-sided exterior configuration, typically hexagonal, to permit a separate tool-driving socket member (not shown) to be releasably mounted thereon. This is particularly desirable for use with large-diameter sockets. The hub 181 preferably has a detent member 182 mounted in an opening 183 formed through the wall thereof, and urged outwardly by a spring 184 for engagement with a suitable detent groove or recess on the socket to releasably accommodate the socket on the drive hub. The drive hub also preferably has an opening 185, of any desired cross-sectional configuration, projecting coaxially through the entire tool-driving member 123B so as to permit an elongate threaded rod to project therethrough during utilization of the attachment tool.

The operation of the attachment tool 111a is otherwise identical to the operation of the attachment tool 111 described above, so that further detail description thereof is believed unnecessary.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An elongate drive attachment for releasable connection between a tool such as a socket element and a rotatable driver for permitting rotatable driving of the tool about a tool-driving axis which is substantially perpendicular to a driving axis of the driver, said attachment comprising:

a longitudinally elongate housing having a head end and a tail end, said housing including first and second platelike walls which are disposed in parallel and generally superimposed relationship and extend longitudinally throughout the length of the housing, said first and second platelike walls being spaced apart to define a chamber therebetween, said housing also including fastener means for fixedly joining the first and second platelike walls in spaced apart relationship, said housing having a height as measured transversely between said platelike walls which is a small fraction of the overall longitudinal length of the housing, said head end of said housing also having coaxially aligned access openings formed through said first and second platelike walls and defining said tool-driving axis which is coaxial of said access openings and extends in substantially perpendicular relationship to the longitudinal direction of the housing;

a tool-driving member rotatably supported on said head end of said housing generally within said access openings for rotation about said tool-driving axis, said tool-driving member having an external drive gear fixedly and concentrically provided thereon and disposed between said first and second platelike walls, said tool-driving member also having an opening extending coaxially therethrough and accessible from either side of said attachment;

an elongate drive shaft disposed within said chamber and extending longitudinally along and rotatably supported on said housing for rotation about the driving axis which extends generally parallel to said longitudinal direction and which substantially intersects said tool-driving axis, said drive shaft having an inner end which is positioned within said chamber but is spaced longitudinally from said tool-driving member, said inner end including a drive pin eccentrically mounted thereon and projecting longitudinally in generally parallel relationship to the driving axis, said drive shaft having an outer end which projects outwardly from the tail end of said housing beyond said first and second platelike walls and has a drive part coaxially fixed thereto for releasable engagement with a driver;

a reversible ratchet mechanism disposed within said chamber between said first and second platelike walls and including a driving pawl engageable with said drive gear for effecting steplike driving of said tool-driving member about said tool-driving axis, said ratchet mechanism including a ratchet housing disposed between said first and second platelike walls and having a yoke part at one end thereof which is rotatably engaged and supported on said tool-driving member so that said ratchet housing is supported for oscillating movement on said tool-driving member about said tool-driving axis, said ratchet housing having a driving slot formed transversely thereof at an end of said ratchet housing which is remote from said yoke part, said ratchet housing being angularly oscillated about said tool-driving axis in response to rotation of said drive shaft;

said ratchet mechanism including a reversing member movably mounted on said ratchet housing and cooperating with said driving pawl for permitting said driving pawl to be selectably positioned for driving engagement with the drive gear, said reversing member including a portion which projects transversely through one of said platelike walls and has a manually-engageable actuating part positioned exteriorly of said one platelike wall; and a displacement multiplying means disposed within said chamber and longitudinally drivingly interconnected between the inner end of said drive shaft and the remote end of said ratchet housing for increasing the magnitude of the displacement of the ratchet housing during oscillation thereof in response to rotation of said drive shaft.

2. A drive attachment according to claim 1, wherein said housing includes a pair of longitudinally-spaced support blocks extending transversely between and being fixedly connected to said first and second platelike walls for defining said chamber therebetween, said drive shaft being rotatably supported on and extending between and through said support blocks, and opposite sides of said housing as defined between said first and second platelike walls being opened.

3. A drive attachment according to claim 1, wherein said displacement-multiplying means includes a lever member disposed within said chamber and supported for pivoting movement relative to said housing about a pivot axis which is disposed generally parallel with said tool-driving axis but is displaced therefrom generally along the longitudinal direction of the housing, said lever member having a first elongate arm which extends from the pivot axis and is engaged with the drive pin on the drive shaft, the lever also including a second elongate arm which extends from the pivot axis and is engaged with the remote end of the ratchet housing, said second lever arm being of greater length than said first lever arm.

4. A drive attachment according to claim 3, wherein said second lever arm has a length which is at least about 1.5 times the length of said first lever arm.

5. An elongate drive attachment for releasable connection between a tool such as a socket element and a rotatable driver for permitting rotatable driving of the tool about a tool-driving axis which is substantially perpendicular to a driving axis of the driver, said attachment comprising:

a longitudinally elongate housing defining a head end at one end thereof and a tail end at the other end thereof, said housing including opposed walls which are spaced a small distance apart and define a chamber therebetween, said housing having a height as measured transversely between said opposed walls which is a small fraction of the overall longitudinal length of the housing;

said housing at the head end thereof including coaxially aligned access openings formed through said walls and defining said tool-driving axis which extends perpendicular to the longitudinal direction;

a tool-driving member rotatably supported on and within the head end of said housing for rotation about said tool-driving axis, said tool-driving member being rotatably supported within said access openings and extending generally therebetween, said tool-driving member having an opening extending coaxially therethrough for permitting projection of a rod or the like therethrough from either side of said drive attachment, said tool-driving member also including an annular gear member which is fixedly and concentrically provided on said tool-driving member and is positioned within said chamber between said walls;

an elongate drive shaft disposed within said chamber and extending longitudinally along and rotatably supported on said housing for rotation about the driving axis which extends generally parallel to said longitudinal direction and which substantially intersects said tool-driving axis, said drive shaft having an inner end which is positioned within said chamber but is spaaced longitudinally from said tool-driving member, said inner end including an inner end drive part mounted thereon, said drive shaft having a coaxial outer end drive part positioned adjacent the tail end of said housing for releasable engagement with a driver;

a reversible ratchet mechanism disposed within said chamber between said walls and including a driving pawl engageable with said drive gear for effecting steplike driving of said tool-driving member about said tool-driving axis, said reversible ratchet mechanism including a ratchet housing disposed between said walls and having a yoke part at one end thereof which is rotatably engaged and supported on said tool-driving member so that said ratchet housing is supported for oscillating movement on said tool-driving member about said tool-driving axis, said ratchet housing having a ratchet housing drive part at an end of said ratchet housing which is remote from said yoke part, said ratchet housing being angularly oscillated about said tool-driving axis in response to rotation of said drive shaft;

said ratchet mechanism including a reversing member movably mounted on said ratchet housing and cooperating with said driving pawl for permitting said driving pawl to be selectably positioned for driving engagement with the drive gear, said reversing member including a portion which projects transversely through one of said walls and has a manually-engageable actuating portion positioned exteriorly of said one wall; and a displacement multiplying means disposed within said chamber and longitudinally drivingly interconnected between the inner end drive part of said drive shaft and said ratchet housing drive part for increasing the magnitude of the displacement of the ratchet housing during oscillation thereof in response to rotation of said drive shaft.

6. The elongate drive attachment according to claim 5, wherein said displacement multiplying means includes a lever extending between and drivingly engaged with said inner end drive part and said ratchet housing drive part for translating the rotational motion of said drive shaft into the oscillating movement of said ratchet housing, said lever being supported for oscillating movement about a pivot axis.

7. The elongate drive attachment according to claim 6, wherein said lever has a first lever arm positioned between said pivot axis and said inner end drive part, and a second lever arm positioned between said pivot axis and said ratchet housing drive part, and said second lever arm being longer than said first lever arm to increase the magnitude of the displacement of the ratchet housing during oscillation thereof in response to rotation of said drive shaft.

8. A drive attachment for releasable connection between a tool such as a socket element and a rotatable driver for permitting rotatable driving of the tool about a tool-driving axis, said attachment comprising:

a longitudinally elongate housing having a head end and a tail end, said housing having a height which is a small fraction of the overall longitudinal length of the housing, said head end of said housing also having coaxially aligned access openings formed therethrough and defining said tool-driving axis which is coaxial of said access openings and extends in substantially perpendicular relationship to the longitudinal direction of the housing;

a tool-driving member rotatably supported on said head end of said housing generally near said access openings for rotation about said tool-driving axis, said tool-driving member having an external drive gear fixedly and concentrically provided thereon and disposed within said housing;

an elongate drive shaft disposed within said housing and extending longitudinally along and rotatably supported on said housing for rotational motion about a driving axis which extends generally parallel to said longitudinal direction, said drive shaft having an inner end which is positioned within said housing but is spaced longitudinally from said tool-driving member, said drive shaft having an outer end which is positioned adjacent the tail end of said housing and has a drive part coupled thereto for releasable engagement with a driver;

a ratchet mechanism disposed within said housing and including a driving pawl engageable with said drive gear for effecting steplike driving of said tool-driving member about said tool-driving axis, said ratchet mechanism including a ratchet housing disposed within said housing and having a yoke part at one end thereof which is rotatably engaged and supported on said tool-driving member so that said ratchet housing is supported for oscillating movement on said tool-driving member about said tool-driving axis, said ratchet housing being angularly oscillated about said tool-driving axis in response to rotation of said drive shaft; and a driving and displacement multiplying means disposed within said housing and longitudinally drivingly interconnected between the inner end of said drive shaft and said ratchet housing for oscillatingly driving the ratchet housing and increasing the magnitude of the displacement of the ratchet housing during oscillation thereof in response to rotation of said drive shaft.

9. The drive attachment according to claim 8, wherein said driving and displacement multiplying means includes a lever oscillating about a pivot axis having a first lever arm connected between said pivot axis and said inner end of said drive shaft, and a second lever arm connected between said pivot axis and said ratchet housing, and said second lever arm being longer than said first lever arm to increase the magnitude of the displacement of the ratchet housing during oscillation thereof in response to rotation of said drive shaft.

10. The drive attachment according to claim 9, wherein a drive pin is eccentrically mounted on said inner end of said drive shaft, and a slot is provided in an end of said first lever arm for receiving said drive pin, whereby said drive pin oscillates said first arm in response to the rotational motion of said drive shaft.

11. The drive attachment according to claim 9, wherein said ratchet housing has a slot therein, said slot receiving said second lever arm to cause oscillation of said ratchet housing in response to the oscillation of said second lever arm.

12. The drive attachment according to claim 8, wherein said ratchet mechanism includes a reversing member movably mounted on said ratchet housing and cooperating with said driving pawl for permitting said driving pawl to be selectably positioned for driving engagement with the drive gear, said reversing member including a portion which projects transversely through said housing and has a manually-engageable actuating part positioned exteriorly of said housing.

13. The drive attachment according to claim 8, wherein said driving and displacement multiplying means includes a lever extending between said inner end of said drive shaft and said ratchet housing for translating the rotational motion of said drive shaft into oscillating movement of said ratchet housing, said lever being supported for oscillating movement about a pivot axis.

* * * * *